US006241201B1

(12) United States Patent
Wang

(10) Patent No.: US 6,241,201 B1
(45) Date of Patent: Jun. 5, 2001

(54) SUPPORT FRAME OF GOLF BAG

(76) Inventor: Bae-Luh Wang, P.O. Box 23-487, Changhua City (TW)

( * ) Notice: Subject to any disclaimer, the term of this patent is extended or adjusted under 35 U.S.C. 154(b) by 0 days.

(21) Appl. No.: 09/417,075

(22) Filed: Oct. 13, 1999

(51) Int. Cl.[7] ..... A63B 55/00
(52) U.S. Cl. ..... 248/96; 206/315.7
(58) Field of Search ..... 248/96, 97, 163.1, 248/165, 170, 171; 206/315.7, 315.3, 315.4

(56) References Cited

U.S. PATENT DOCUMENTS 5,209,350 * 5/1993 Maeng ..... 206/315.7
5,464,180 * 11/1995 Cheng ..... 248/96
5,507,384 * 4/1996 Maeng ..... 206/315.7
5,597,144 * 1/1997 Lee ..... 248/96
5,634,616 * 6/1997 Wang et al. ..... 248/96
5,681,016 * 10/1997 Wang ..... 248/96
5,762,189 * 6/1998 Reimers ..... 206/315.7
5,823,485 * 10/1998 Park ..... 248/96
5,857,567 * 1/1999 Cheng ..... 206/315.7
5,901,845 * 5/1999 Cheng ..... 206/315.7
6,098,797 * 8/2000 Han ..... 206/315.7

* cited by examiner

*Primary Examiner*—Anita M. King

(57) ABSTRACT

A golf bag is provided with a support frame capable of supporting securely the golf bag on a surface of the golf course regardless of the surface feature of the golf course. The support frame comprises two expandable legs, with each having an elastic element capable of compressing in response to a surface feature of the golf course. The support frame further comprises a movable base which is linked with the two expandable legs by a link rod. The two expandable legs are actuated by the link rod to expand in opposite directions at such time when the movable base is located on the surface of the golf course. The golf bag is thus securely supported on the surface by the two expandable legs and the movable base, which form together three supporting points.

1 Claim, 10 Drawing Sheets

A

SUPPORT FRAME OF GOLF BAG

FIELD OF THE INVENTION

The present invention relates generally to a golf bag, and more particularly to a support frame of the golf bag.

BACKGROUND OF THE INVENTION

The conventional golf bag is generally provided with a support frame capable of holding securely the golf bag on a flat surface of the golf course. The golf course is not entirely flat; it has many depressions, elevations, and slopes. As a result, the support frame of the conventional golf bag is not adapted to support securely the golf bag on the golf course. A caddie often has to take pains to find a flat surface on the golf course to place the golf bag.

SUMMARY OF THE INVENTION

The primary objective of the present invention is to provide a golf bag with a support frame capable of supporting securely the golf bag on a golf course regardless of the surface features of the golf course.

In keeping with the principle of the present invention, the foregoing objective of the present invention is attained by a support frame comprising two expandable legs, each having an elastic element capable of compressing in response to a surface feature of the golf course. The support frame further comprises a movable base which is linked with the two expandable legs by a link rod. The two expandable legs are actuated by the link rod to expand at such time when the movable base is located on a surface of the golf course. As a result, the golf bag is securely supported on the surface by the two expandable legs and the movable base, which form together three supporting points.

The foregoing objective, features, functions, and advantages of the present invention will be more readily understood upon a thoughtful deliberation of the following detailed description of the present invention with reference to the accompanying drawings.

BRIEF DESCRIPTION OF THE DRAWINGS

FIG. 2-1 shows a partial schematic view of the link rod of the present invention.

FIG. 2-2 shows another partial schematic view of the link rod of the present invention.

FIG. 7-1 shows an enlarged schematic view of a portion indicated by a circle A as shown in FIG. 7.

FIG. 8-1 shows another rear schematic view of the present invention at work.

DETAILED DESCRIPTION OF THE INVENTION

Figure 1:
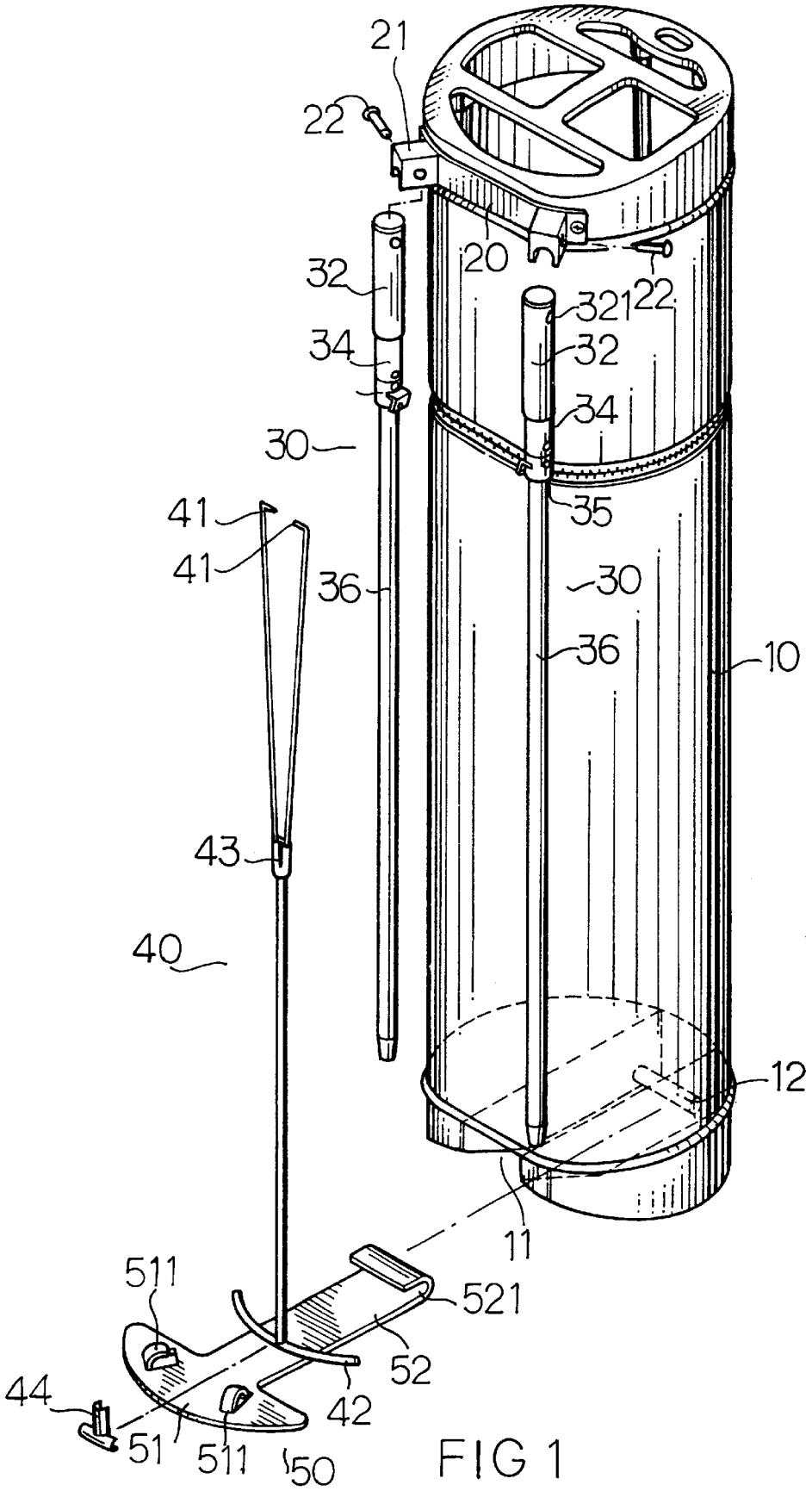
FIG. 1 shows a partial exploded view of the present invention.
Figure 2:
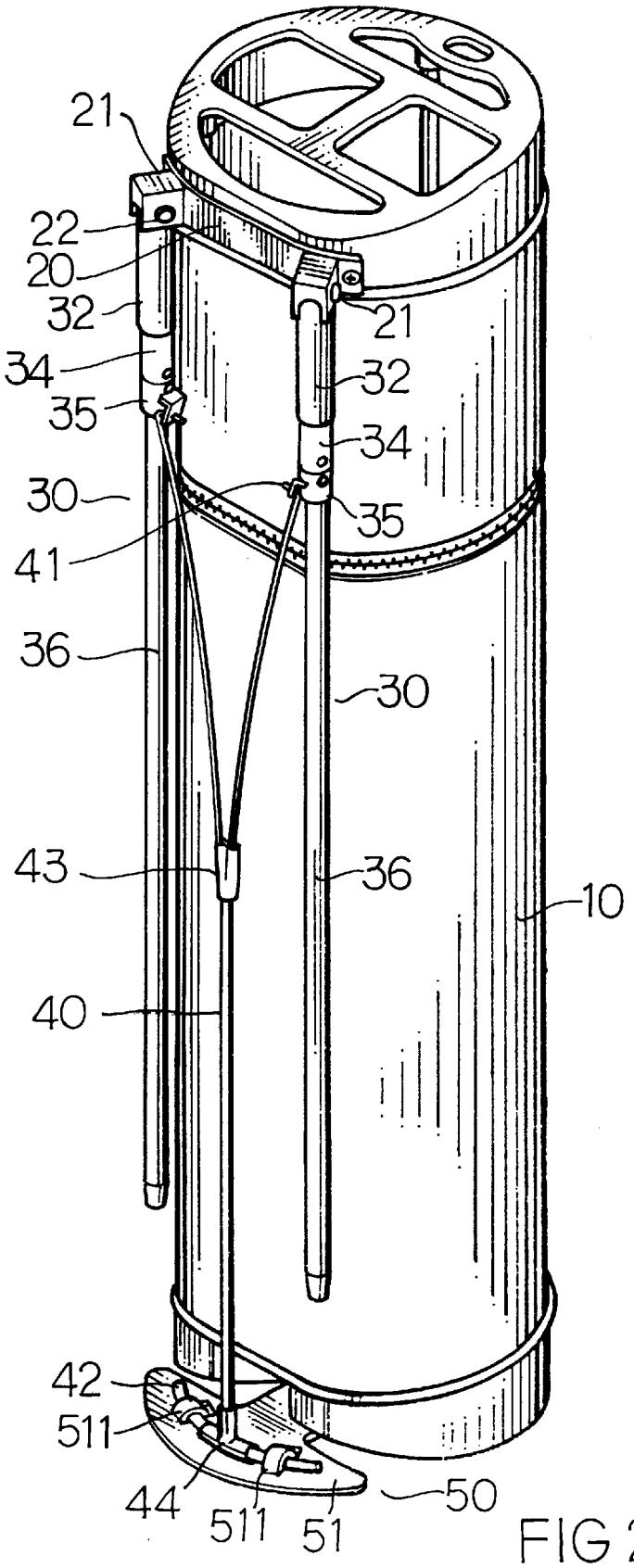
FIG. 2 shows a perspective view of the present invention in combination.
Figure 2:
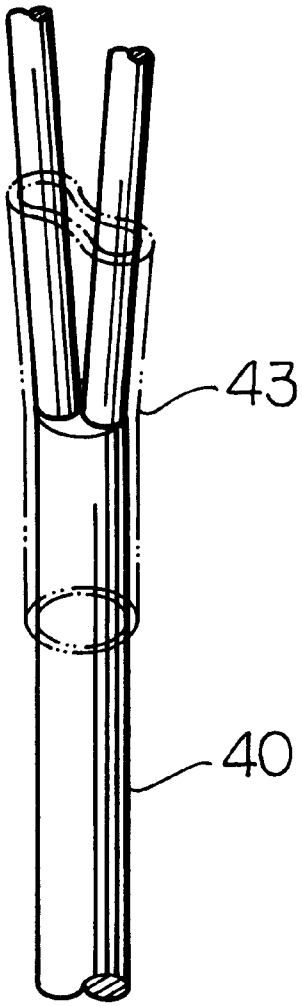
Figures 1, 2:
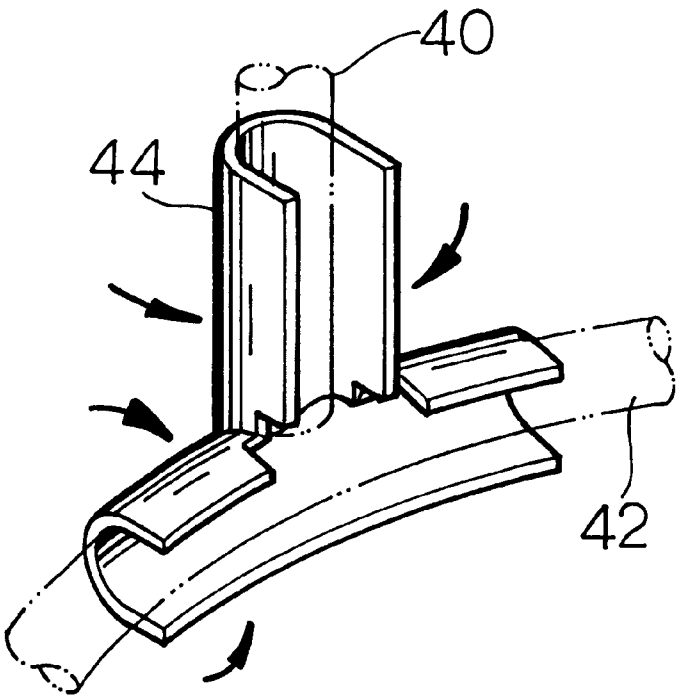

As shown in FIGS. 1 and 2, a golf bag 10 is provided with a support frame of the present invention. The support frame comprises a fastening seat 20, two expandable legs 30, a link rod 40, and a movable base 50.

The golf bag 10 is provided at the bottom thereof with a slot 11 and a locating rod 12 secured to one end of the slot 11.

The fastening seat 20 is secured to the top of the golf bag 10 by a plurality of screws and is provided with two legs 21 separated at an interval.

The two expandable legs 30 are identical in construction to each other and are fastened with the fastening seat 20 in a similar manner. As a result, only one expandable leg 30 is described hereinafter.

Figure 3:
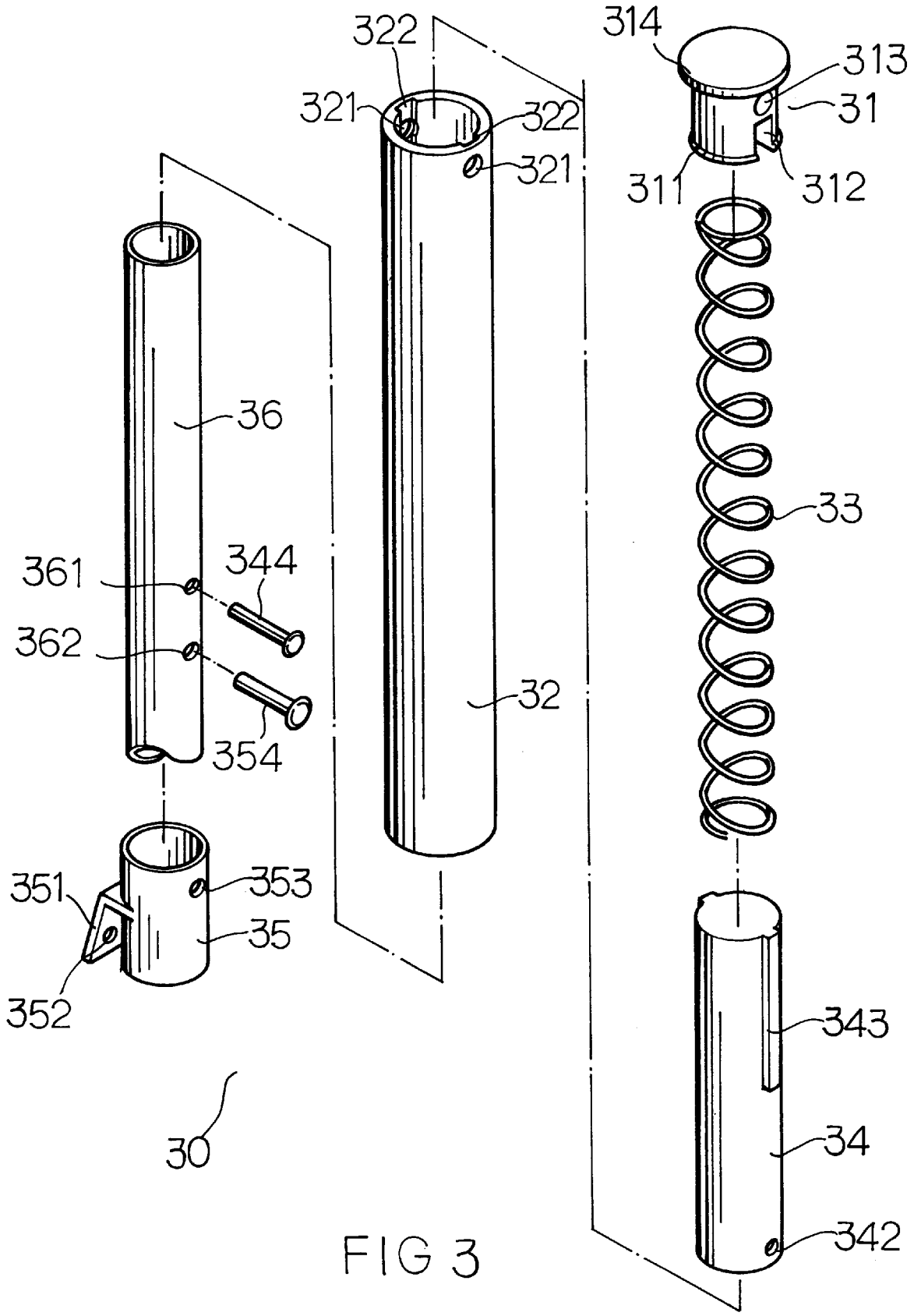
FIG. 3 shows an exploded view of the expandable leg of the support frame of the present invention.
Figure 4:
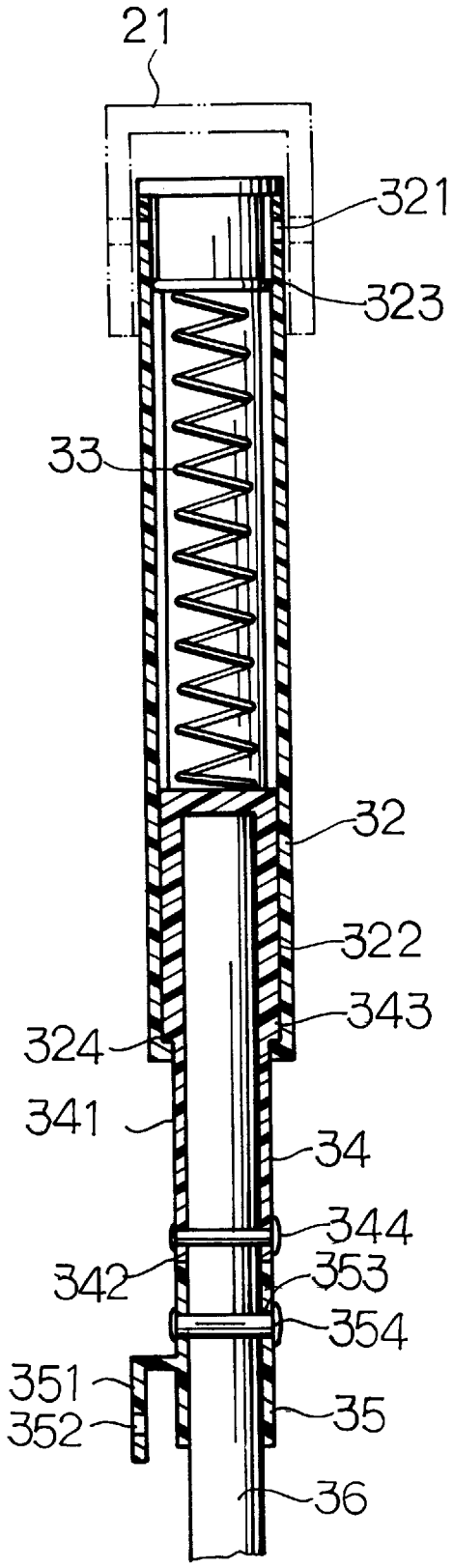
FIG. 4 shows a longitudinal sectional view of the expandable leg of the present invention in combination.
Figure 5:
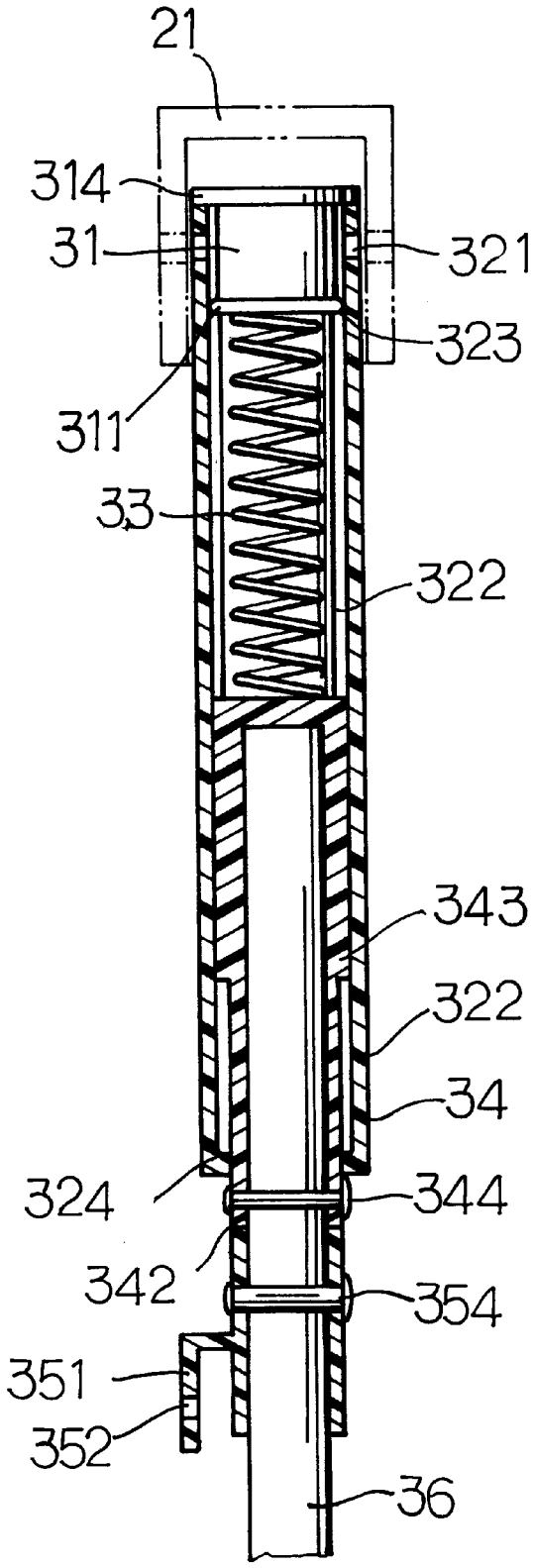
FIG. 5 shows a longitudinal sectional view of the expandable leg of present invention at work.

The expandable leg 30 is formed of a cap 31, as shown in FIG. 3, a support tube 32, an elastic element 33, a slide rod 34, a receiving tube 35, and a leg tube 36.

The cap 31 is provided at the bottom thereof with a protruded ring 311 and a cut 312. The cap 314 is further provided at the top thereof with a stop cover 314. Located between the stop cover 314 and the cut 312 is a locating hole 313.

The support tube 32 is provided at the top end thereof with two through holes 321 opposite to each other, and in the inner wall of the top end thereof with two slide slots 322 opposite to each other, and a circular slot 323. The support tube 32 is fastened at the top end thereof with the fastening seat 20 by a rivet 22 which is received in the two through holes 321 of the support tube 32 and two through holes (not shown in the drawings) of the lug 21 of the fastening seat 20. The cap 31 is fitted into the top end of the hollow support tube 32 such that the protruded ring 311 of the cap 31 is retained in the circular slot 323 of the support tube 32. The support tube 32 is of a hollow construction such that the support tube 32 is provided with an upper hollow segment and a lower hollow segment, which are not shown in the drawings and are provided at the juncture thereof with a stop ring 324. The upper hollow segment is greater in hole diameter than the lower hollow segment.

The elastic element 33 is received in the upper hollow segment of the support tube 32.

The slide rod 34 is dimensioned to fit into the upper hollow segment of the support tube 32 and is provided in the outer wall of the upper portion thereof with two slide blocks 343 opposite to each other. The slide rod 34 is further provided at the bottom end thereof with a through hole 342 and an inner round slot 341 extending along the longitudinal direction of the slide rod 34. The slide rod 34 is slidably received in the upper hollow segment of the support tube 31 such that the two slide blocks 343 are slidably received in the two slide slots 322 of the support tube 32, and that the two slide blocks 343 are stopped by the stop ring 324 of the support tube.32. The slide rod 34 slides in the support tube 32 with stability, thanks to the two slide blocks 343 which are confined in the two slide slots 322 of the support tube 32.

The receiving tube 35 is of a hollow construction and is provided in the outer wall thereof with a retaining piece 351 having a through hole 352. The receiving tube 35 is further provided in the proximity of the upper end thereof with a through hole 353.

The leg tube 36 is of a hollow construction and is provided in the lower segment thereof with a first through hole 361 and a second through hole 362. The leg tube 36 is fitted into the lower hollow segment of the support tube 32 such that the top end of the leg tube 36 is received in the inner round slot 341 of the slide rod 34, and that the leg tube 36 is located in the slide rod 34 by a locating pin 344 which is received in the first through hole 361 of the leg tube 36 and through hole 342 of the slide rod 34. As a result, the up-and-down sliding motion of the slide rod 34 is confined. The lower end of the leg tube 36 is fitted into the receiving tube 35 and is fastened with the receiving tube 35 by a fastening pin 354 which is received in the second through hole 362 of the leg tube 36 and the through hole 353 of the receiving tube 35.

Figure 6:
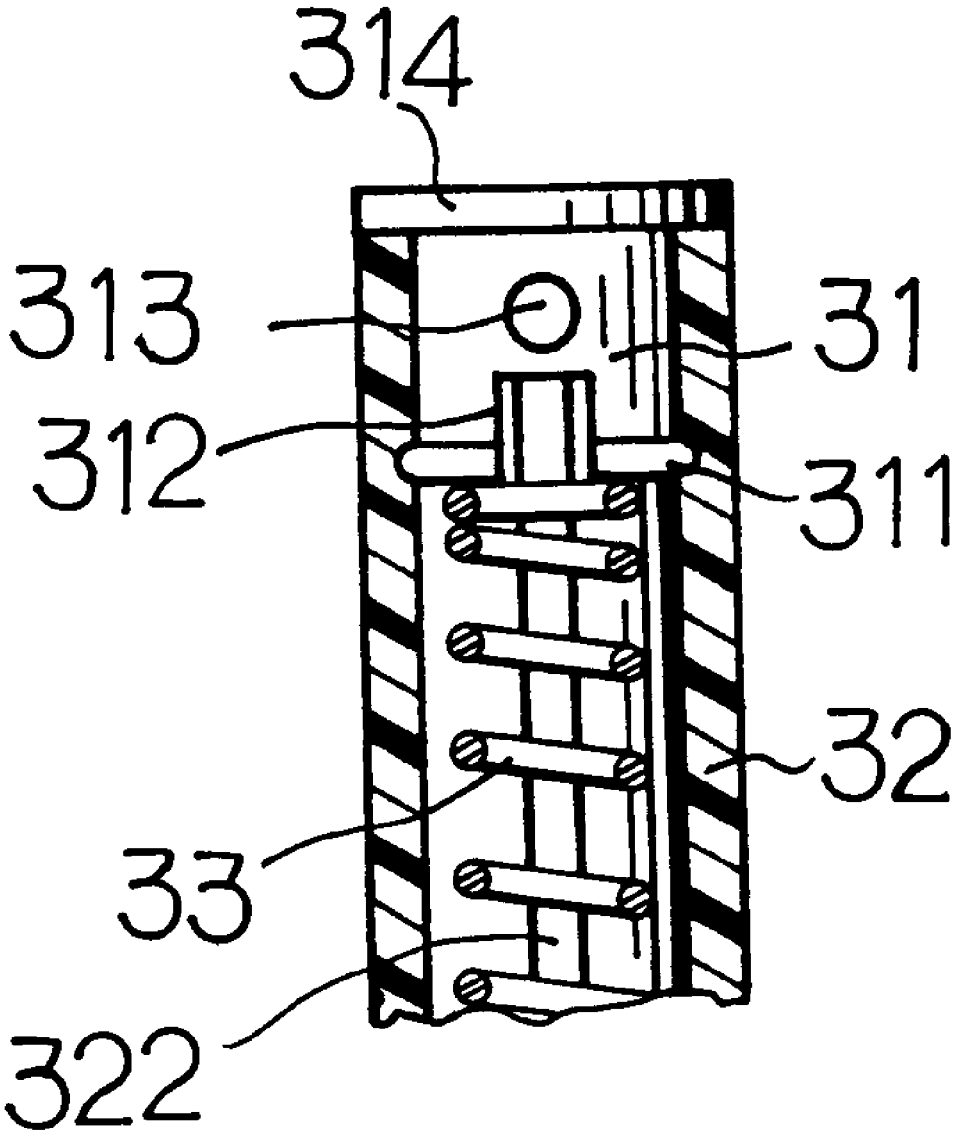
FIG. 6 shows a partial longitudinal sectional view of the expandable leg of the present invention.

As shown in FIG. 6, the cap 31 is joined with the top end of the support tube 32 such that the protruded ring 311 of the cap 31 is retained in the circular slot 323 of the support tube 32, and that the locating hole 313 of the cap 31 is aligned with the through holes 321 of the top end of the support tube 32. The cap 31 and the top end of the support tube 32 are located by the lug 21 of the fastening seat 20 in conjunction with a locating pin 22 which is received in the locating hole 313 of the cap 31 and the two through holes 321 of the top end of the support tube 32.

The link rod 40 is of a Y-shaped construction and is provided with two retaining ends 41. The link rod 40 is connected with the two expandable legs 30 such that the two retaining ends 41 are retained in the through holes 352 of the retaining pieces 351 of the receiving tubes 35 of the two expandable legs 30. The link rod 40 is provided at the bottom end thereof with an arcuate rod 42 fastened therewith. The arcuate rod 42 is fastened with the bottom end of the link rod 40 by welding in conjunction with a reinforcing sleeve 44, as shown in FIG. 2-1. The branched portion of the link rod 40 is reinforced by a reinforcing sleeve 43, as shown in FIG. 2-2.

The movable base 50 is of a T-shaped construction and is provided at one end thereof with an arcuate plate 51 which is in turn provided with two retaining pieces 511 of a hooked construction and opposite in location to each other, as shown in FIG. 1. The bottom end of the link rod 40 is retained by the movable base 50 such that the arcuate rod 42 of the link rod 40 is retained by the two retaining pieces 511 of the arcuate plate 51 of the movable base 50. The movable base 50 has a shank 52 extending from the arcuate plate 51 and having at the free end thereof a hooked portion 521. The movable base 50 is securely retained in the bottom of the golf bag 10 such that the shank 52 of the movable base 50 is securely received in the slot 11 of the bottom of the golf bag 10, and that the hooked portion 521 of the shank 52 of the movable base 50 retains securely the locating rod 12 of he bottom of the golf bag 10.

Figure 7:
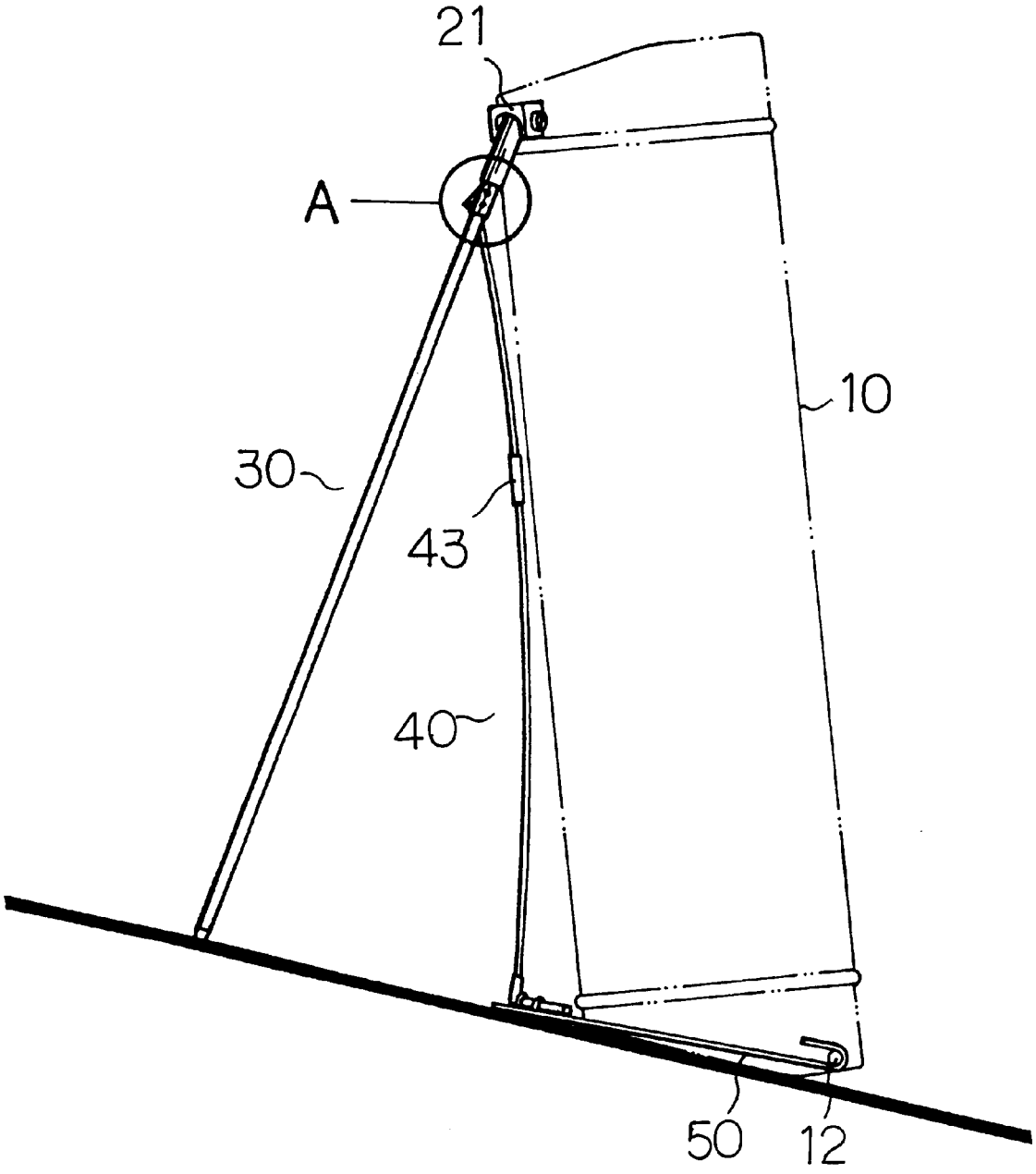
FIG. 7 shows a side schematic view of the present invention at work.
Figures 1, 7:
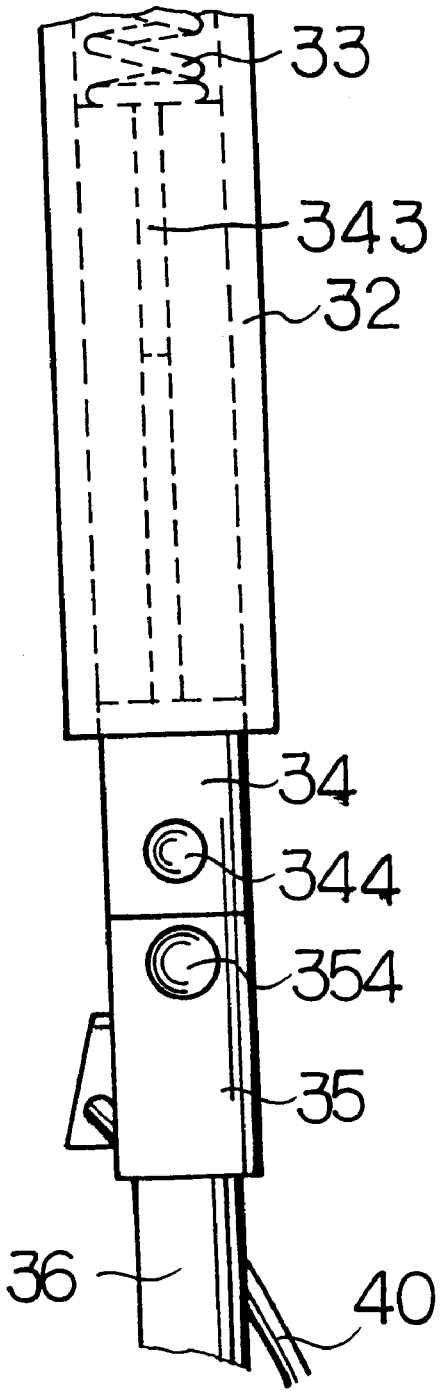
Figures 1, 8:
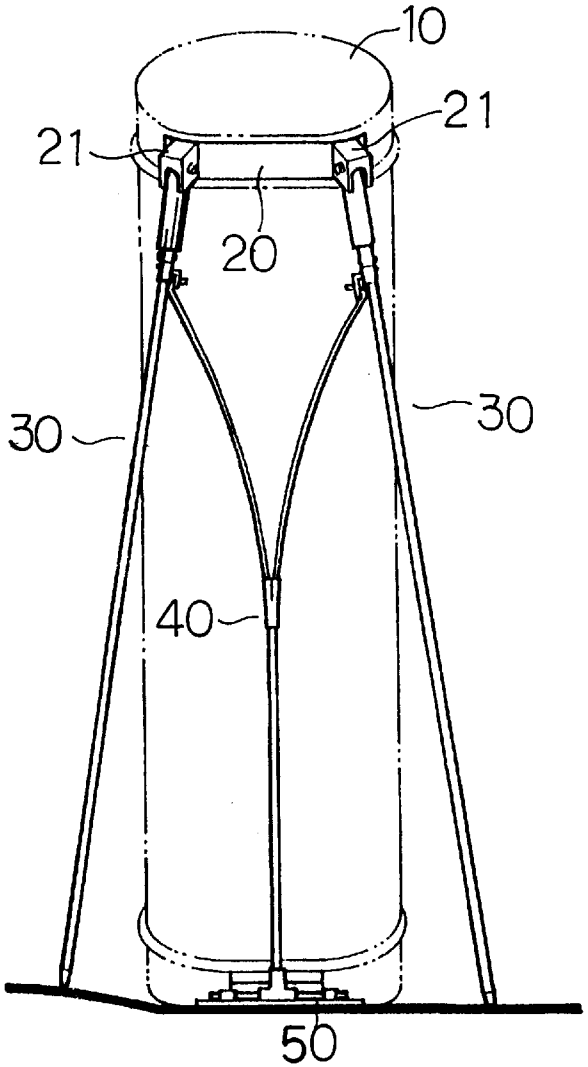
FIG. 8 shows a another rear schematic view of the present invention at work.
Figure 8:
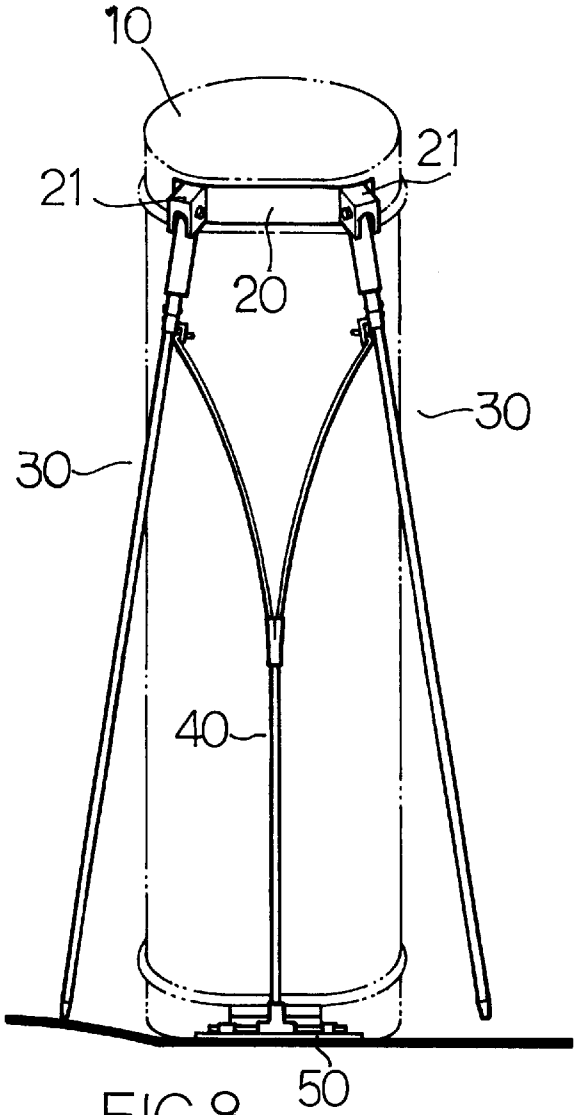

As illustrated in FIGS. 7 7-1,8, and 8-1 the golf bag 10 is always supported securely on a surface of the golf course by the support frame of the present invention in view of the fact that the two expandable legs 30 and the movable base 50 form three supporting points. In the event that the golf bag 10 is tilted, the movable base 50 comes in contact with the surface such that the movable base 50 moves upward on the hooked portion 521 acting as a fulcrum. In the meantime the link rod 40 is actuated to cause the two expandable legs 30 to expand in opposite directions. As a result, the golf bag 10 is securely supported on the three supporting points. In addition, the two expandable legs 30 can be located on a surface regardless of the features of the surface, thanks to the elastic element 33 capable of compressing in response to a surface feature, such as a depression or elevation, of the golf course.

The movable base 50 is provided with the arcuate plate 51 which serves to give an added contact area between the movable base 50 and the surface of the golf course.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended

What is claimed is:

1. A golf bag provided with a support frame which is fastened with a fastening seat of the top of the golf bag, and a slot and a locating rod of the bottom of the golf bag, said support frame comprising:

two expandable legs fastened at a top end thereof with the fastening seat of the golf bag;

a link rod of a Y-shaped construction and provided with two retaining ends which are respectively engaged with said two expandable legs, said link rod further provided with an arcuate rod fastened therewith such that said arcuate rod is opposite in location to said two retaining ends; and a movable base of a T-shaped construction and provided at one end thereof with an arcuate plate which is in turn provided with two retaining pieces opposite in location to each other for retaining said arcuate rod of said link rod, said movable base further provided with a shank extending from said arcuate plate and having at a free end thereof a retaining portion, said movable base being retained in the bottom of the golf bag such that said shank of said movable base is retained in the slot of the bottom of the golf bag, and that said retaining portion of said shank of said movable base retains the locating rod of the bottom of the golf bag, said movable base coming in contact with a surface and moving upward on said retaining portion acting as a fulcrum at such time when the golf bag is tilted, thereby actuating said link rod to cause said two expandable legs to expand in opposite directions to form three supporting points along with said movable base;

wherein said link rod has a branched portion from which said two retaining ends are extended whereby said branched portion is reinforced by a first reinforcing sleeve, said link rod being fastened with said arcuate rod by welding in conjunction with a second reinforcing sleeve;

wherein said two expandable legs comprise:

a cap provided at a bottom thereof with a protruded ring and a cut, said cap further provided at a top thereof with a stop cover, said cap further provided with a locating hole located between said stop cover and said cut;

a support tube of a hollow construction and provided at a top end thereof with two through holes opposite to each other, and in an inner wall of the top end thereof with two slide slots opposite to each other, and a circular slot, said support tube further provided in an interior thereof with an upper hollow segment and a lower hollow segment smaller in hole diameter than said upper hollow segment, said upper hollow segment and said lower hollow segment being provided at a juncture thereof with a stop ring, said support tube being engaged with said cap such that said protruded ring of said cap is retained in said circular slot of said support tube whereby said support tube is fastened at the top end thereof with the fastening seat of the top of the golf bag;

an elastic element received in said upper hollow segment of said support tube;

a slide rod fitted into said upper hollow segment of said support tube and provided in an outer wall thereof with two slide blocks opposite to each other, said slide rod further provided at a bottom end thereof with a through hole and an inner round slot extending along the longitudinal direction of said slide rod whereby said slide rod is slidably disposed in said upper hollow segment of said support tube such that said two slide blocks of said slide rod are slidably received in said two slide slots of said support tube, and that said two slide blocks of said slide rod are stopped by said stop ring of said support tube;

a receiving tube of a hollow construction and provided in an outer wall thereof with a retaining piece having a through hole, said receiving tube further provided at an upper end thereof with a through hole; and a leg tube of a hollow construction and provided in a lower segment thereof with a first through hole and a second through hole, said leg tube being fitted into said lower hollow segment of said support tube such that a top end of said leg tube is received in said inner round slot of said slide rod, and that said leg tube is located in said slide rod by a locating pin which is received in said first through hole of said leg tube and said through hole of said slide rod, and further that a lower end of said leg tube is fitted into said receiving tube whereby said leg tube is fastened with said receiving tube by a fastening pin which is received in said second through hole of said leg tube and said through hole of said upper end of said receiving tube.

* * * * *